US007757627B2

(12) United States Patent
Cheng et al.

(10) Patent No.: US 7,757,627 B2
(45) Date of Patent: Jul. 20, 2010

(54) AUTOMATIC COATING DEVICE

(75) Inventors: Yi-Lun Cheng, Taipei (TW); Feng-Ku Wang, Taipei (TW); Chun-Lung Lin, Taipei (TW); Chih-Kai Yang, Taipei (TW)

(73) Assignee: Inventec Corporation, Taipei (TW)

( * ) Notice: Subject to any disclaimer, the term of this patent is extended or adjusted under 35 U.S.C. 154(b) by 873 days.

(21) Appl. No.: 11/639,162

(22) Filed: Dec. 15, 2006

(65) Prior Publication Data

US 2007/0137565 A1 Jun. 21, 2007

(30) Foreign Application Priority Data

Dec. 16, 2005 (TW) ..... 94222075 U

(51) Int. Cl.
*B05C 17/06* (2006.01)

(52) U.S. Cl. ..... 118/213; 118/301; 118/324; 118/406; 118/500; 118/504; 118/505

(58) Field of Classification Search ..... 118/213, 118/301, 324, 406, 500, 504, 505; 427/282
See application file for complete search history.

(56) References Cited

U.S. PATENT DOCUMENTS

| | | | | |
|---|---|---|---|---|
| 5,389,148 | A * | 2/1995 | Matsunaga | 118/300 |
| 6,066,206 | A * | 5/2000 | Doyle et al. | 427/98.5 |
| 2002/0102754 | A1 * | 8/2002 | Fujimori et al. | 438/22 |

* cited by examiner

*Primary Examiner*—George R Koch, III
(74) *Attorney, Agent, or Firm*—Morris, Manning & Martin LLP; Tim Tingkang Xia

(57) ABSTRACT

An automatic coating device uses a driving motor and a conveyer to form a cyclically rotating module. An injector filled with a coating material is disposed on one side of the conveyer. When an object to be coated is disposed on the other side of the moving conveyer, the coating material is then applied onto the object by the injector. This can increase the coating speed and quality.

4 Claims, 8 Drawing Sheets

AUTOMATIC COATING DEVICE

CROSS-REFERENCE TO RELATED APPLICATIONS

This non-provisional application claims priority under 35 U.S.C. §119(a) on Patent Application No(s). 094222075 filed in Taiwan, R.O.C. on Dec. 16, 2005, the entire contents of which are hereby incorporated by reference.

BACKGROUND OF THE INVENTION

1. Field of Invention

The invention relates to a coating device, and more particularly, to an automatic coating device driven with a conveyer.

2. Related Art

FIGS. 1A, 1B, and 1C are schematic views of manual coating according to the prior art. In usual manual coating, a lower tool 100 is used to hold an object 110 to be coated. An upper tool 130 is then disposed on the object 110. The upper tool 130 has an injection opening 131 located at the position corresponding to the position on the object 110 to be coated with the coating material 150. The coating material 150 is coated evenly in the upper tool 130 and fills the injection opening 131. A scraper 170 is used to fill the coating material 150 in the injection opening 131. After removing excess coating material 150, the upper tool 130 is taken away. Therefore, the prior method is difficult in implementing mass coating, whereas the quality cannot be guaranteed. It is thus necessary to develop a device that is suitable for mass coating.

SUMMARY OF THE INVENTION

In view of the foregoing, an objective of the invention is to provide an automatic coating device for an object to be coated automatically, thereby promoting the coating efficiency.

To achieve the above objective, an automatic coating device disclosed herein uses a driving motor and a conveyer to form a cyclically rotating module. An injector filled with a coating material is disposed on one side of the conveyer. When an object to be coated is disposed on the other side of the moving conveyer, the coating material is then applied by the injector onto the object.

An injection opening is form in the conveyer according to the coating shape. When the injector is aimed at the injection opening, the coating material is coated onto the object via the injection opening of the conveyer.

The injector includes a body and an extension board. The body holds the coating material and has an outlet for the coating material to escape from the body. The extension board is connected to the outlet and touches the surface of the conveyer. When the injection opening aligns with the outlet so that the coating material is applied onto the object via the outlet, the extension board pushes the coating material to fill the injection opening. The coating material is thus coated onto the object in accord with the shape of the injection opening.

The disclosed automatic coating device achieves the above goal in an automatic way. Therefore, it has a high coating efficiency, stability, and quality. The extension board provided to pass through the surface of the injection opening enables the coating material to fill the injection opening. Thus, no coating material would be wasted. One can change the thickness and shape of the coating by merely changing the thickness of the conveyer and the shape of the injection opening. Consequently, the disclosed automatic coating device has the advantages of fast coating and highly adaptive for different products.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow illustration only, and thus are not limitative of the present invention, and wherein.

DETAILED DESCRIPTION OF THE INVENTION

Figure 1A:
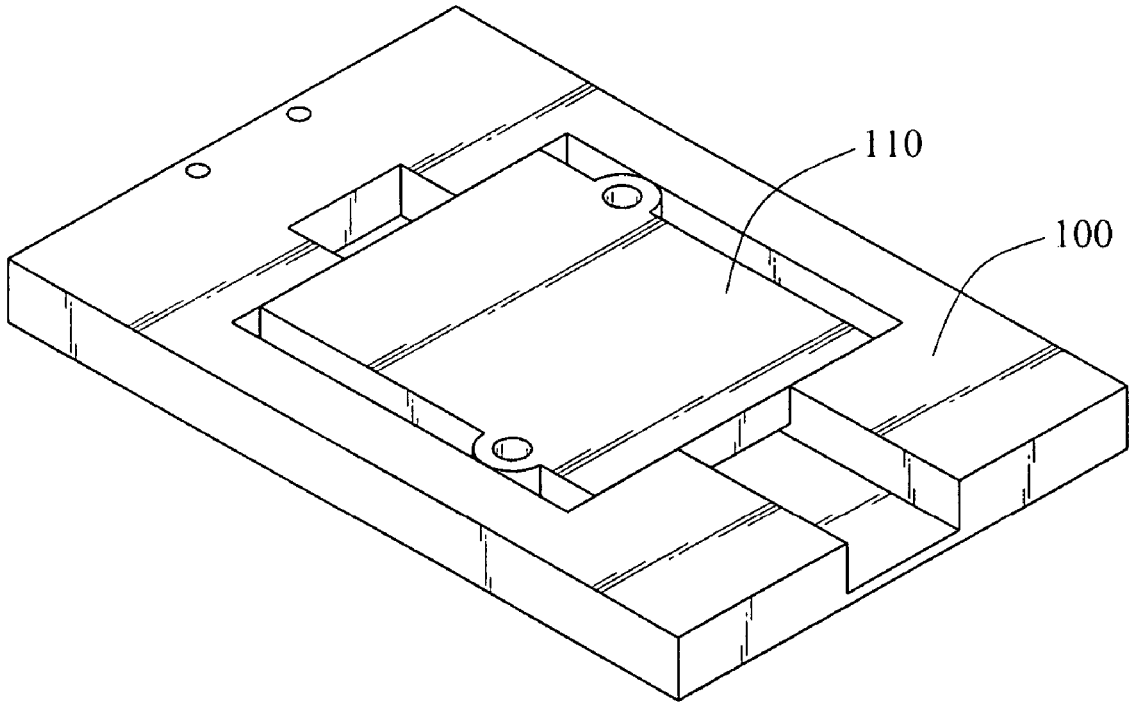
FIG.1A (PRIOR ART)
FIGS. 1A, 1B, and 1C are schematic views of manual coating.
Figure 1B:
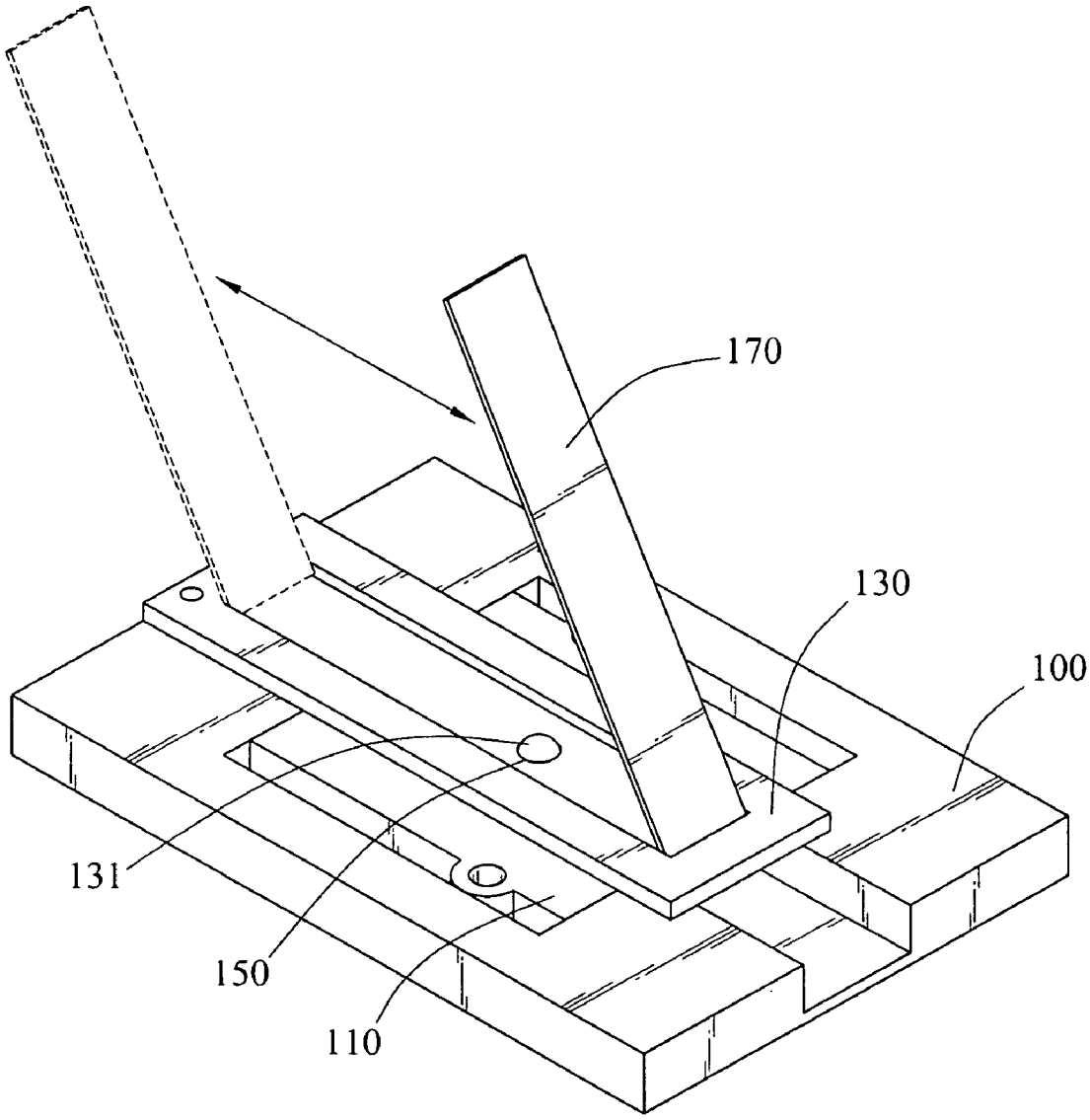
FIG.1B (PRIOR ART)
Figure 1C:
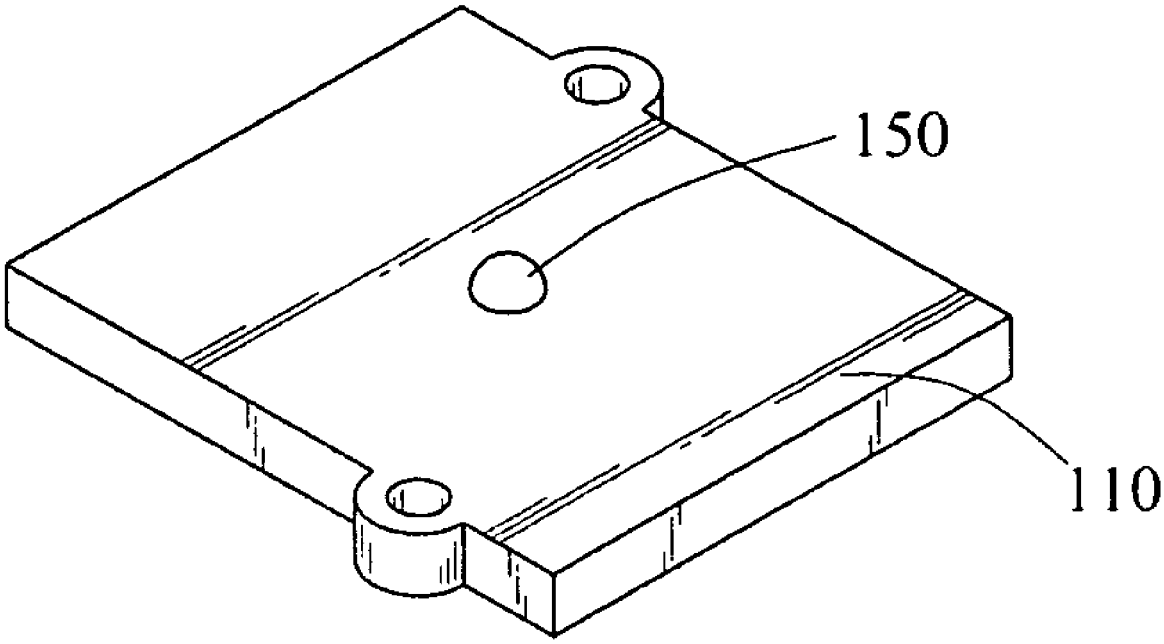
FIG.1C (PRIOR ART)
Figure 2:
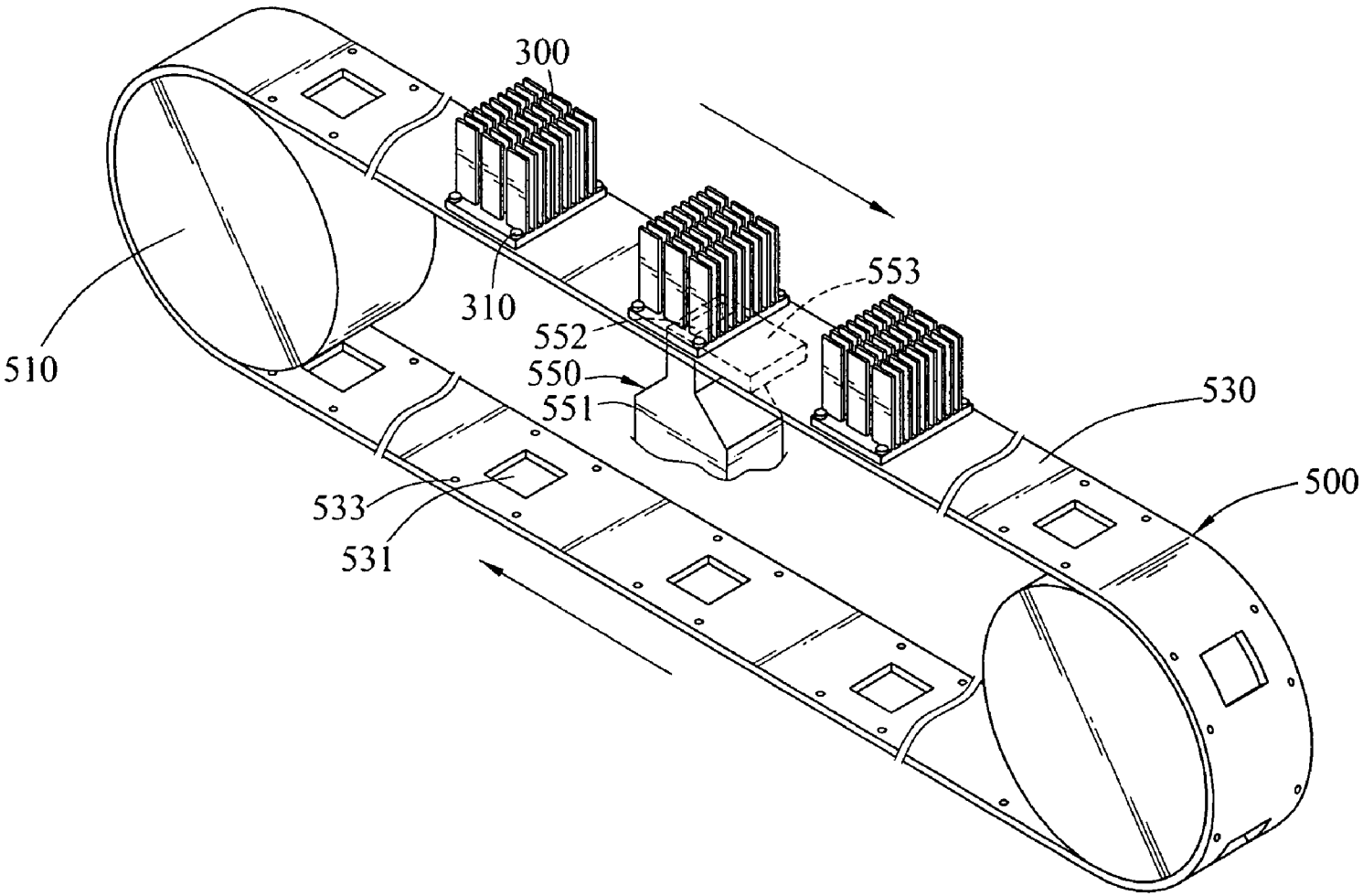
FIG. 2 is an assembly view of the invention.
Figure 3:
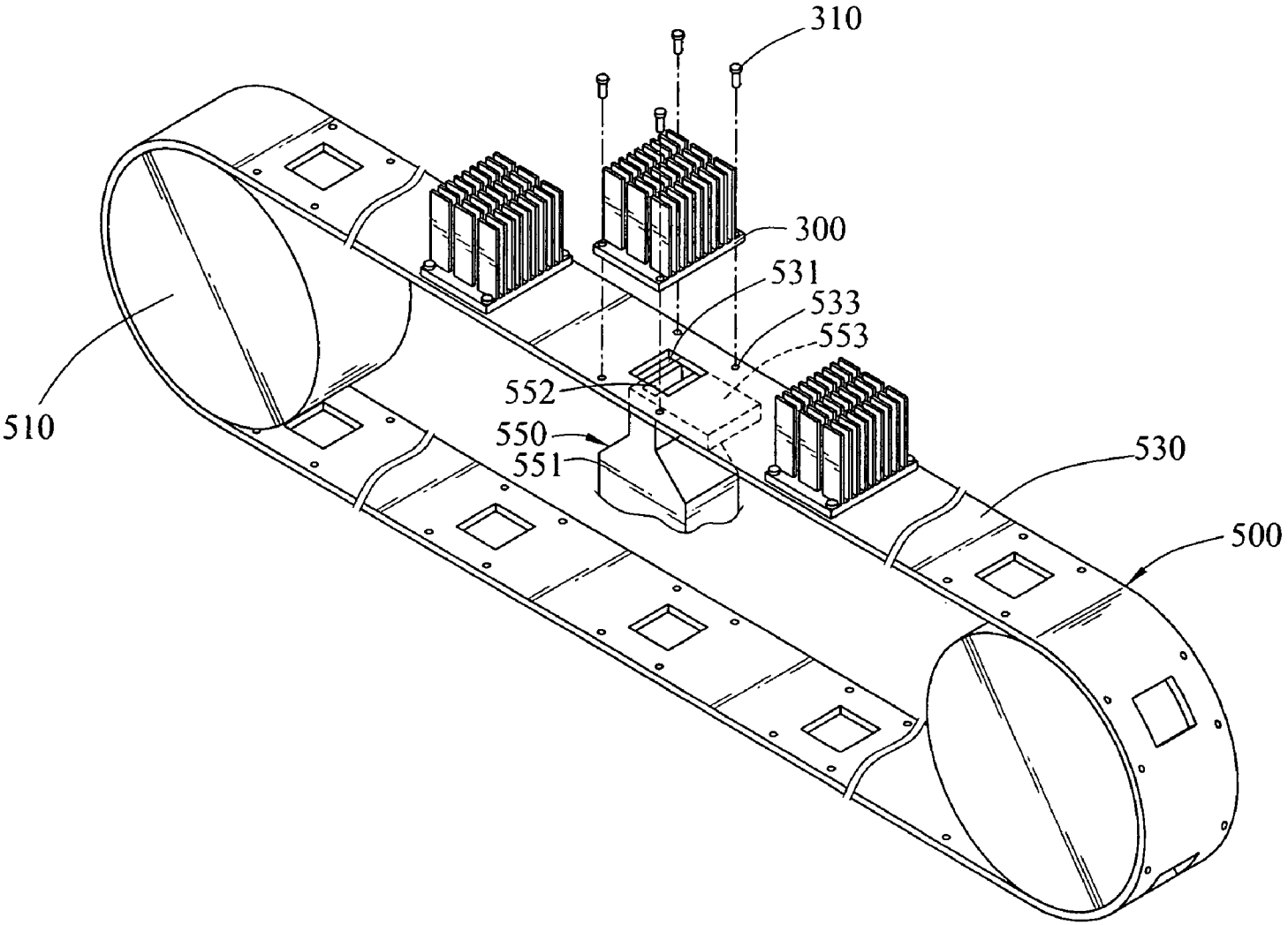
FIG. 3 is an exploded view of the invention.
Figure 4A:
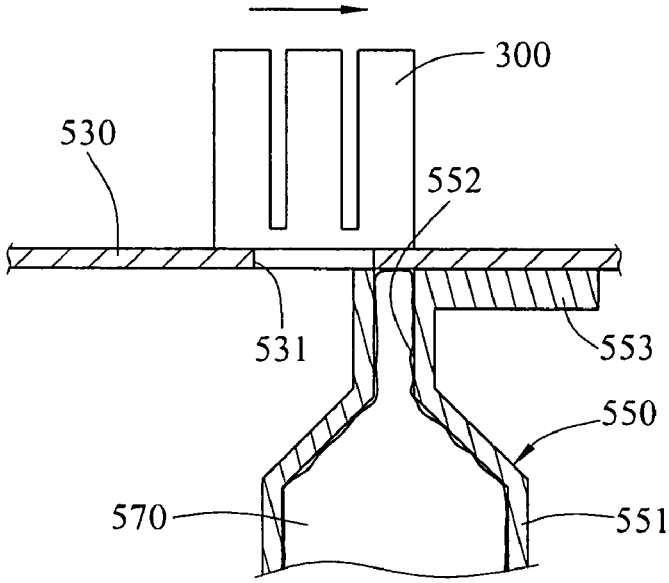
FIGS. 4A, 4B, 4C, and 4D show the action of filling the coating material according to the invention.
Figure 4B:
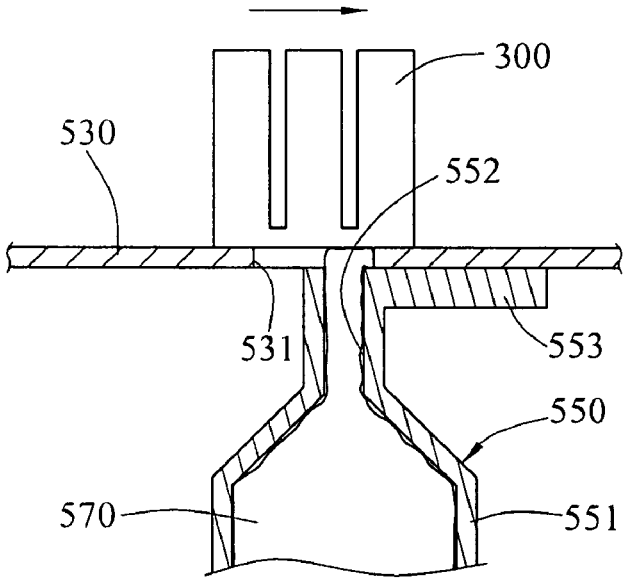
Figure 4C:
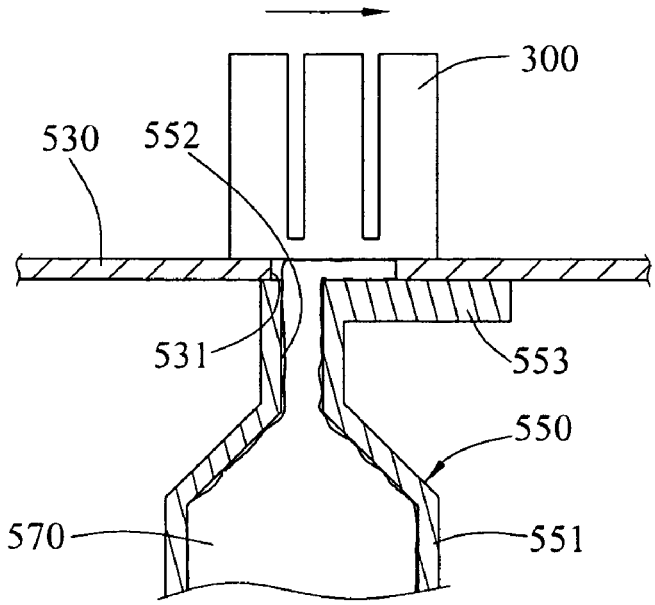
Figure 4D:
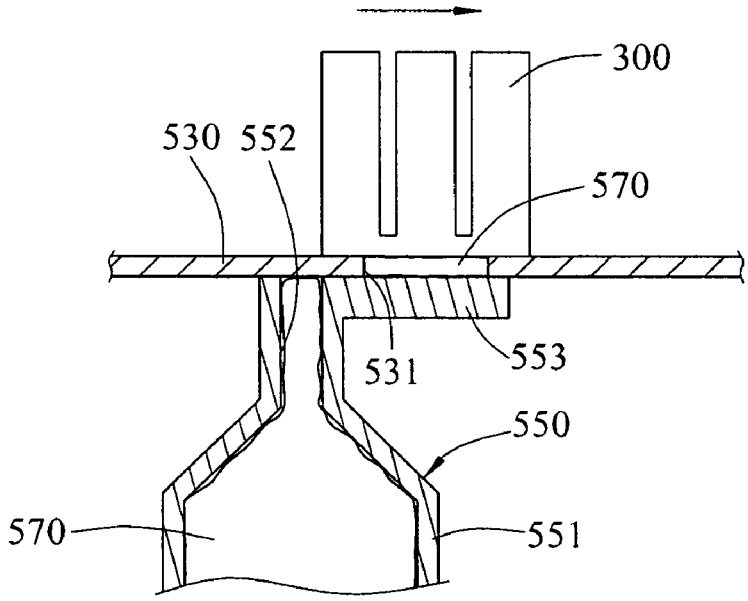

Referring to FIGS. 2, 3 and 4A, an automatic coating device 500 according to the invention can automatically coat a coating material 570 onto an object 300 to be coated, avoiding the time-consuming manual coating. As shown in FIGS. 2, 3 and 4A, the automatic coating device 500 includes a driving motor 510, a conveyer 530, and an injector 550. The driving motor 510 drives the conveyer 530 to cyclically rotate. A plurality of injection openings 531 are formed on the conveyer 530. The object 300 is disposed on one side of the conveyer 530 so that the coating area of the object 300 is exposed by one of the injection opening 531. The object 300 is temporally fixed on the conveyer 530 and driven by the conveyer 530 into motion.

The injector 550 includes a body 551 and an extension board 553. The body 551 accommodates the coating material 570. The body 551 is formed with an outlet 552, through which the coating material 570 leaves the body 551. The extension board 553 is protruded from the body 551 and beside the outlet 552 so that the surface of the extension board 553 touches the surface of the conveyer 530. When the injection opening 531 aligns with the outlet 552 for applying the coating material 570 onto the object 300 via the outlet 552, the extension board 553 pushes the coating material 570 to fill the injection opening 531 until the coating is completed.

Referring to FIGS. 4A, 4B, 4C, and 4D, the injector 550 is disposed on the other side of the conveyer 530. The injector 550 holds the coating material 570. When the injector 550 aligns with the injection opening 531, the coating material 570 leaves the injector 550 and arrives on the coating area of the object 300 via the injection opening 531. When the injector 550 does not align with the injection opening 531, the conveyer 530 prevents the coating material 570 from escaping the injector 550. Therefore, the automatic coating device 500 continuously conveys the objects 300 to be coated for the injector 550 to spray the coating material 570 on the coating area of the object 300 with uniform coating thickness.

Figure 5:
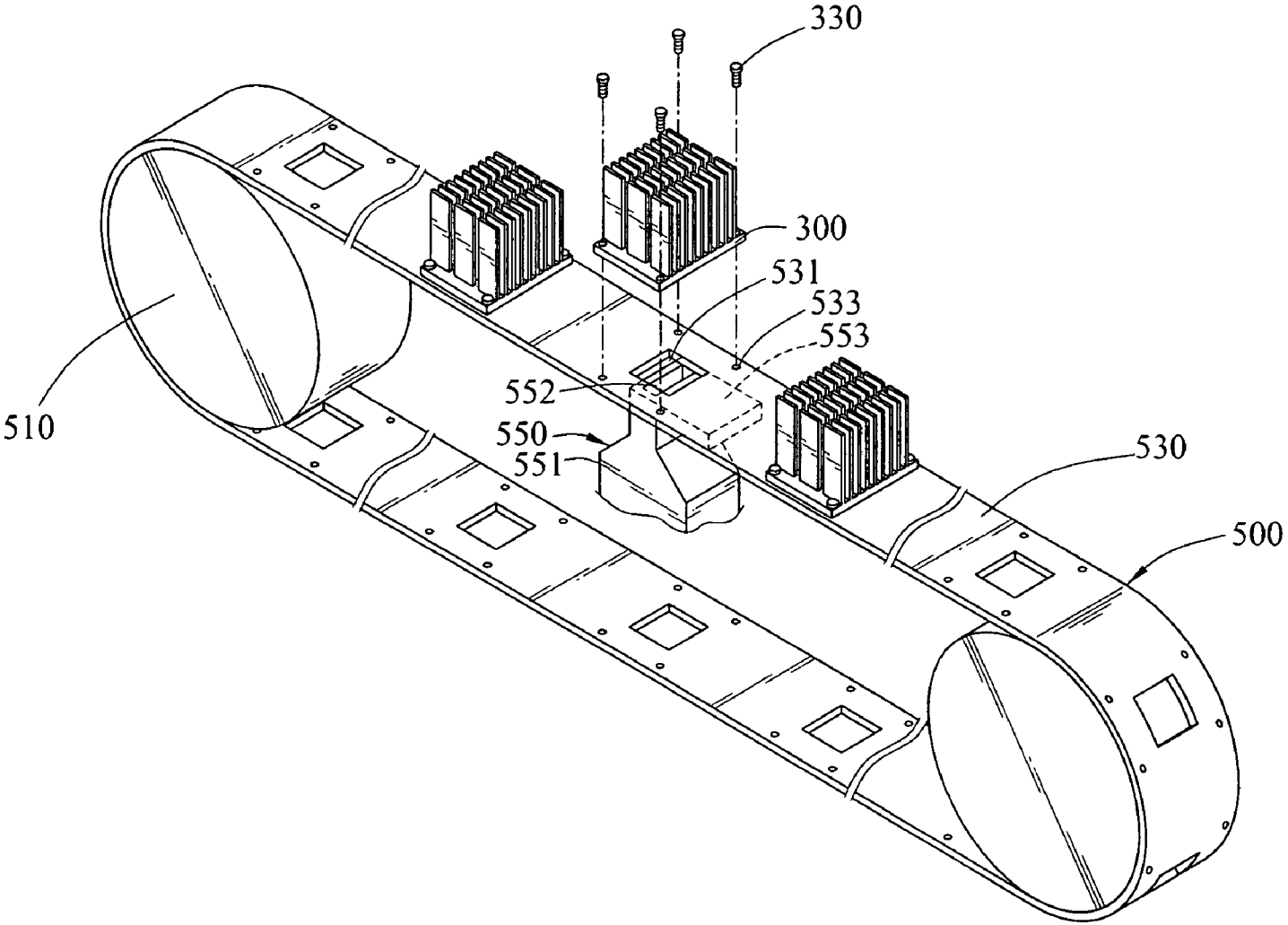
FIG. 5 is an exploded view of another embodiment of the invention.

Referring to FIGS. 3 and 5, a plurality of fixing hole 533 are formed next to the injection opening 531, and the corresponding fixing holes are also formed on the object 300. Furthermore, the object 300 is provided with fixing pins 310 at positions corresponding to the fixing holes 533. When the object 300 is disposed on the conveyer 530, the fixing pins 310 are inserted into the fixing holes 533 so that the object 300 is held at the injection opening 531. This enables the object 300 to move under the driving force of the conveyer 530. Besides, the fixing pins 310 can be replaced by screws 330. As the object 300 is fixed on other elements (not shown) using the screws 330, the object 300 is positioned and fixed on the conveyer 530 by the screws 330 thereon.

Therefore, the automatic coating device 500 of the present invention can replace the time-consuming manual coating. It can increase the coating efficiency and quality. On the other hand, using the extension board to pass through the surface of the injection opening enables the coating material to fill the entire injection opening without wasting. Changing the thickness of the conveyer changes the thickness of coating. Changing the shape of the injection opening also changes the shape of the coating material. Therefore, in addition to rapid coating, the disclosed automatic coating device has the advantage of being adaptive for different products.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An automatic coating device, comprising:

a driving motor;

a conveyer driven by the driving motor to cyclically rotate and having at least one opening for an object to be coated and driven to move by the conveyer; and an injector, which accommodates a coating material and pushes the coating material to be applied onto the object to be coated when it aligns with the injection openings, wherein the injector comprises:

a body, which accommodates the coating material and has an outlet for the coating material to leave the body; and an extension board, which is protruded from the body and beside the outlet so that the surface of the extension board touches the surface of the conveyer, wherein when the outlet aligns with the injection opening for the coating material to be applied onto the object, pushes the coating material to fill the injection opening.

2. The automatic coating device of claim 1, wherein at least one fixing hole is formed next to the injection opening, and at least one fixing component corresponding to the fixing holes is provides, so that the object is held on the injection opening by insert the fixing component into the fixing hole, and thus the object is driven by the conveyer to move.

3. The automatic coating device of claim 2, wherein the fixing component is a fixing pin.

4. The automatic coating device of claim 2, wherein the fixing component is a screw.

* * * * *